US005574824A

United States Patent [19]

Slyh et al.

[11] Patent Number: 5,574,824

[45] Date of Patent: Nov. 12, 1996

[54] ANALYSIS/SYNTHESIS-BASED MICROPHONE ARRAY SPEECH ENHANCER WITH VARIABLE SIGNAL DISTORTION

[75] Inventors: Raymond E. Slyh, Dayton; Randolph L. Moses, Worthington; Timothy R. Anderson, Dayton, all of Ohio

[73] Assignee: The United States of America as represented by the Secretary of the Air Force, Washington, D.C.

[21] Appl. No.: 422,729

[22] Filed: Apr. 14, 1995

Related U.S. Application Data

[63] Continuation of Ser. No. 225,878, Apr. 11, 1994, abandoned.

[51] Int. Cl.[6] ..... G10L 5/06; G10L 3/02

[52] U.S. Cl. ..... 395/2.35; 395/2.29; 395/2.42

[58] Field of Search ..... 395/2, 2.25, 2.72, 395/2.29, 2.35, 2.42,2.14, 2.77

[56] References Cited

U.S. PATENT DOCUMENTS

| | | | |
|---|---|---|---|
| 4,131,760 | 12/1978 | Christensen | 179/1 |
| 4,536,887 | 8/1985 | Kaneda et al. | 381/92 |
| 4,956,867 | 9/1990 | Zurek et al. | 381/94.1 |
| 5,212,764 | 5/1993 | Ariyoshi | 395/2 |
| 5,271,088 | 12/1993 | Bahler | 395/2 |
| 5,400,409 | 3/1995 | Linhard | 381/92 |

OTHER PUBLICATIONS

Wang et al., "An approach of dereverberation using multi–microphone sub–band envelope estimation", ICASSP–91, 1991 International Conference on Acoustics, Speech and Signal processing, pp. 953–956 vol. 2.

J. B. Allen, D. A. Berkley and J. Blauert, "Multimicrophone signal–processing technique to vol. remove room reverberation from speech signals", Journal of the Acoustical Society of America, 62, pp. 912–915, Oct. 1977.

P. J. Bloom and G. D. Cain, "Evaluation of two–input speech dereverberation techniques", in Proceedings of the International Conference on Acoustics, Speech and Signal Processing, (Paris, France), pp. 164–167, May 1982.

S. F. Boll, "Suppression of acoustic noise in speech using spectral subtraction", IEEE Transactions on Acoustics, Speech, and Signal Processing, vol. 27, pp. 113–120, Apr. 1979.

R. A. Mucci, "A comparison of efficient beamforming algorithms", IEEE Transactions on Acoustics, Speech, and Signal Processing, vol. 32, pp. 548–558, Jun. 1984.

(List continued on next page.)

*Primary Examiner*—Allen R. MacDonald
*Assistant Examiner*—Richemond Dorvil
*Attorney, Agent, or Firm*—Bernard E. Franz; Thomas L. Kundert

[57] ABSTRACT

A microphone array speech enhancement algorithm based on analysis/synthesis filtering that allows for variable signal distortion. The algorithm is used to suppress additive noise and interference. The processing structure consists of delaying the received signals so that the desired signal components add coherently, filtering each of the delayed signals through an analysis filter bank, summing the corresponding channel outputs from the sensors, applying a gain function to the channel outputs, and combining the weighted channel outputs using a synthesis filter. The structure uses two different gain functions, both of which are based on cross correlations of the channel signals from the two sensors. The first gain yields the GEQ-I array, which performs best for the case of a desired speech signal corrupted by uncorrelated white background noise. The second gain yields the GEQ-II array, which performs best for the case where there are more signals than microphones. The GEQ-II gain allows for a trade-off on a channel-dependent basis of additional signal degradation in exchange for additional noise and interference suppression.

8 Claims, 5 Drawing Sheets

Microfiche Appendix Included
(85 Microfiche, 1 Pages)

OTHER PUBLICATIONS

S. S. Narayan, A. M. Peterson, and M. J. Narasimha, "Transform domain LMS algorithm", IEEE Transactions on Acoustics, Speech, and Signal Processing, vol. 31, pp. 609–615, Jun. 1983.

Y. Kaneda and J. Ohga, "Adaptive microphone–array system for noise reduction", IEEE Trans. on Acoustics, Speech, and Signal Processing, vol. 34, pp. 1391–1400, Dec. 1986.

B. Van Veen, "Minimum variance beamforming with soft response constraints", IEEE Transactions on Signal Processing, vol. 39, pp. 1964–1972, Sep. 1991.

O. L. Frost, III, "An algorithm for 2, linearly constrained adaptive array processing", Proceedings of the IEEE, vol. 60, pp. 926–935, Aug. 1972.

R. E. Slyh and R. L. Moses, "Microphone Array Speech Enhancement in Overdetermined Signal Scenarios", in Proceedings of the International Conference on Acoustics, Speech, and Signal Processing, pp. II–347–350, Apr. 27–30, 1993.

R. E. Slyh, "Microphone Array Speech Enhancement in Background Noise and Overdetermined Signal Scenarios", PhD dissertation, The Ohio State University, Mar. 1994.

R. E. Slyh and R. L. Moses, "Microphone–Array Speech Enhancement in Background Noise and Overdetermined Signal Scenarios", submitted to the IEEE Transactions on Speech and Audio Processing in Mar. 1994.

ANALYSIS/SYNTHESIS-BASED MICROPHONE ARRAY SPEECH ENHANCER WITH VARIABLE SIGNAL DISTORTION

RIGHTS OF THE GOVERNMENT

The invention described herein may be manufactured and used by or for the Government of the United States for all governmental purposes without the payment of any royalty.

This application is a continuation of application Ser. No. 08/225,878 filed Apr. 11, 1994, which is hereby abandoned effective with the filing of this application. We hereby claim the benefit under Title 35 United States Code, §120 of said U.S. application Ser. No. 08/225,878.

MICROFICHE APPENDIX

This application includes a microfiche appendix, comprising one fiche with 85 frames.

BACKGROUND OF THE INVENTION

The present invention relates generally to an analysis/synthesis-based microphone array speech enhancer with variable signal distortion.

This invention addresses the problem of enhancing speech that has been corrupted by several interference signals and/or additive background noise. By speech enhancement is meant the suppressing of additive background noise and/or interference, interference which arises in many applications including hands-free mobile telephony, aircraft cockpit communications, and computer speech-to-text devices.

The speech enhancement problem considered has five distinguishing features. First, a speech enhancement algorithm is wanted, an algorithm that is robust to a wide range of interference and noise scenarios. There is motivation here by the success of the human auditory system in suppressing interference and noise in many adverse environments. Second, a priori knowledge of the interference and noise environment is not assumed. This means that a statistical model for the noise is not assumed as is done in many speech enhancement techniques. Third, we are especially interested in very noisy scenarios; very noisy scenarios offer the greatest potential for improvement in speech quality from the use of speech enhancement algorithms. Fourth, some degradation of the desired signal is permitted in exchange for additional interference and noise suppression, since the human auditory system can withstand some degradation of the desired signal. The amount of signal degradation that is tolerated depends on the input signal-to-noise ratio at the array inputs-more signal degradation is tolerated in very noisy scenarios. Fifth, it is assumed that there are outputs from K microphones available for processing, where K is small. Only small numbers of microphones are considered for two reasons. The first reason is that, for many applications, either there is not space for a large array or the cost cannot be justified for a large number of microphones and the necessary processing hardware. The second reason is that the human auditory system uses only two ears, yet it performs well in a wide range of adverse environments. K=2 is considered for most of my work. While it is not a goal to design an array processing structure that is an accurate physiological or psychoacoustical model of auditory processing, we are nevertheless motivated by the success of the human auditory system to consider binaural processing for speech enhancement.

The following publications are of interest.

[1b] J. B. Allen, D. A. Berkley, and J. Blauert, "Multimicrophone signal-processing technique to remove room reverberation from speech signals," Journal of the Acoustical Society of America, vol. 62, pp. 912–915, October 1977.

[2b] P. J. Bloom and G. D. Cain, "Evaluation of two-input speech dereverberation techniques," in Proceedings of the International Conference on Acoustics, Speech, and Signal Processing, (Paris, France), pp. 164–167, May 1982.

[3b] S. F. Boll, "Suppression of acoustic noise in speech using spectral subtraction," IEEE Transactions on Acoustics, Speech, and Signal Processing, vol. 27, pp. 113–120, April 1979. Reprinted in Speech Enhancement, J. S. Lim, ed., Englewood Cliffs, N.J.: Prentice-Hall, 1983.

[4b] R. A. Mucci, "A comparison of efficient beamforming algorithms," IEEE Transactions on Acoustics, Speech, and Signal Processing, vol. 32, pp. 548–558, June 1984.

[5b] S. S. Narayan, A. M. Peterson, and M. J. Narasimha, "Transform domain LMS algorithm," IEEE Transactions on Acoustics, Speech, and Signal Processing, vol. 31, pp. 609–615, June 1983.

[6b] Y. Kaneda and J. Ohga, "Adaptive microphone-array system for noise reduction," IEEE Transactions on Acoustics, Speech, and Signal Processing, vol. 34, pp. 1391–1400, December 1986.

[7b] B. Van Veen, "Minimum variance beamforming with soft response constraints," IEEE Transactions on Signal Processing, vol. 39, pp. 1964–1972, September 1991.

[8b] O. L. Frost, III, "An algorithm for linearly constrained adaptive array processing," Proceedings of the IEEE, vol. 60, pp. 926–935, August 1972.

SUMMARY OF THE INVENTION

An objective of the invention is to provide an improved system using a microphone array to enhance speech that has been corrupted by several interference signals and/or additive background noise.

The invention relates to a microphone array speech enhancement algorithm based on analysis/synthesis filtering that allows for variable signal distortion. The algorithm is used to suppress additive noise and interference. The processing structure consists of delaying the received signals so that the desired signal components add coherently, filtering each of the delayed signals through an analysis filter bank, summing the corresponding channel outputs from the sensors, applying a gain to the channel outputs, and combining the weighted channel outputs using a synthesis filter. The structure uses two different gain functions, both of which are based on cross correlations of the channel signals from the two sensors. The first gain yields the GEQ-I array, which performs best for the case of a desired speech signal corrupted by uncorrelated white background noise. The second gain yields the GEQ-II array, which performs best for the case where there are more signals than microphones. The GEQ-II gain allows for a trade-off on a channel-dependent basis of additional signal degradation in exchange for additional noise and interference suppression.

DETAILED DESCRIPTION

LIST OF PUBLICATIONS DISCLOSING INVENTION

[1a] R. E. Slyh and R. L. Moses, "Microphone Array Speech Enhancement in Overdetermined Signal Scenarios," in Proceedings of the International Conference on Acoustics, Speech, and Signal Processing, pp. II-347–350, Apr. 27–30, 1993.

[2a] R. E. Slyh, "Microphone Array Speech Enhancement in Background Noise and Overdetermined Signal Scenarios", PhD dissertation, The Ohio State University, March 1994.

[3a] R. E. Slyh and R. L. Moses, "Microphone-Array Speech Enhancement in Background Noise and Overdetermined Signal Scenarios," submitted to the IEEE Transactions on Speech and Audio Processing in March, 1994.

My three above publications are included herewith as part of the application as filed.

USE OF THE ALGORITHM

Three broadly defined steps are of interest in using the present speech enhancement algorithm. First collect the noisy speech data and convert it to a format suitable for processing by the algorithm on a digital computer. Second, process the noisy data using the algorithm in order to create an enhanced speech signal. Third, convert the enhanced speech signal into an analog signal and reproduce it through an audio transducer. If the computer processor is fast enough for real-time processing, these three steps can be done in parallel; otherwise, the results of the first and second steps must be stored using some mass storage device. Note that hardware and software packages that perform the first and third steps are currently available from many companies.

Figure 1:
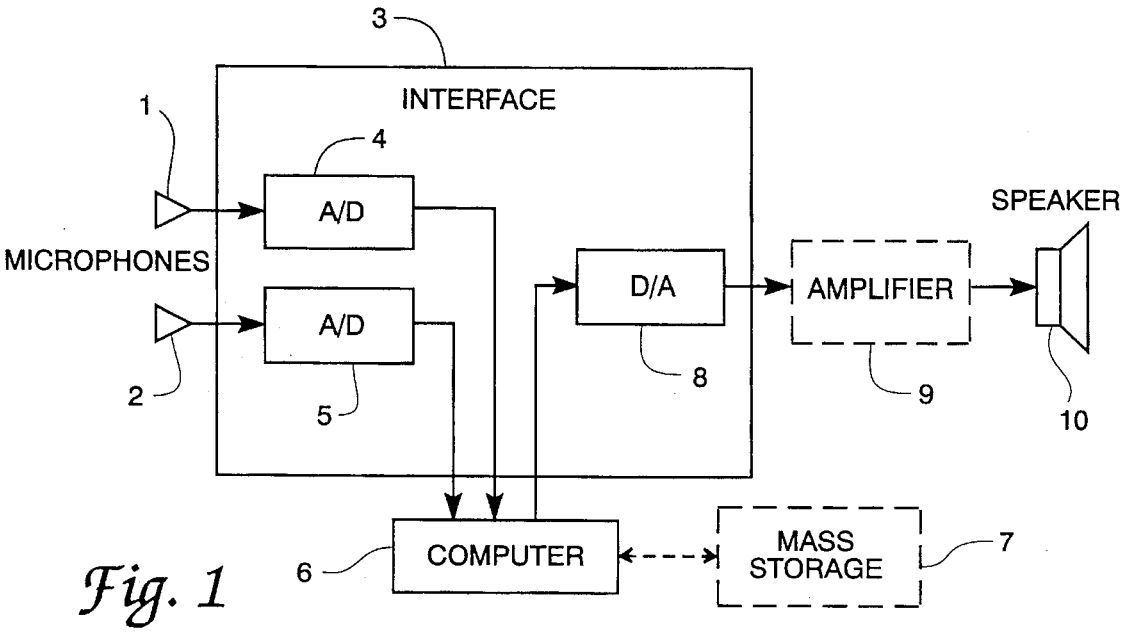
FIG. 1 is a block diagram showing a hardware configuration for the system.

FIG. 1 is a block diagram of a hardware configuration in which the algorithm may be used. The dashed connections and blocks denote optional devices. The block diagram of the interface is conceptual only; it is not part of the algorithm.

The collection of the speech data consists of the following substeps performed in parallel. First, use two microphones 1 and 2 to receive the noisy speech signals. Second, use an interface 3 to transfer samples of the received signals to a computer 6. This process requires the use of analog-to-digital converters 4 and 5. Third, if the computer processor is not capable of real time processing of the noisy speech using the algorithm, then use the computer 6 to send the sampled received signals to a mass storage device 7 for later processing. The source code in the microfiche appendix is based on the assumption that the sampled received signals are stored as alternating binary shorts. In other words, the data are in the following order: sample 1 from microphone 1, sample 1 from microphone 2, sample 2 from microphone 1, sample 2 from microphone 2, etc. The source code is also based on the assumption that the data file name should be of the form infile-prefix.bin (i.e. the file name must end with .bin).

The processing of the sampled received data consists of the following substeps. First, determine the time-difference-of-arrival of the desired signal, perhaps on a trial-and-error basis if need be. Second, create an ASCII header file named infile-prefix.bin.header for the sampled received data according to the following format:

```
# Comments
#
number-of-sensors 2
num-interference-signals 0
data-length xxxxx
sample-frequency-in-Hz yyyyy
tau(0,2) zzzzz
```

where xxxxx denotes the integer data length (i.e. the number of samples collected from a single microphone), yyyyy denotes the floating point sampling frequency in Hertz, and zzzzz denotes the floating point time-difference-of-arrival in seconds of the desired speech signal at the second microphone 2 relative to the first microphone 1. Third, use any knowledge about the signal scenario to determine which of two programs to use to process the received data. If the noise is similar to white background noise, then use the geq1s program, which implements an array later described herein as the GEQ-I otherwise, use the geq2s program, which implements the later described GEQ-II array. See the source code listings in the appendix for instructions on compiling the geq1s and geq2s programs. The best usage of the two programs is as follows:

```
geq1s -c 281 -f filter-file -1 8 infile-prefix outfile-prefix
geq2s -b gain-param -c 21 -f filter-file -1 512 infile-prefix
outfile-prefix
```

where filter-file is a file containing the coefficients of a lowpass filter (see the sample filter file in this attachment), infile-prefix is the input file name excluding the .bin extension, outfile-prefix is the output file name excluding the .bin extension, and gain-param is a constant used in the calculation of the channel-dependent gain exponent. The value of gain-param controls the trade-off between additional signal degradation and additional interference and noise suppression. Larger values of gain-param lead to larger amounts of signal degradation and larger degrees of interference and noise suppression. The source code for geq2s in the appendix uses a form for the channel-dependent exponent that works well when the interference is from other speakers; however, other forms for the channel-dependent exponent can easily be used instead.

The conversion of the enhanced speech signal into a form suitable for listening consists of the following substeps performed in parallel. First, if the computer processor is not capable of real-time processing of the noisy speech using the algorithm, then use the computer 6 to send the stored enhanced speech signal from the mass storage device 7 to the interface 3. Second, convert the enhanced signal to analog form using the digital-to-analog converter 8 on the interface 3. Third, if necessary, amplify the analog enhanced speech signal using an amplifier 9. Fourth, listen to the amplified speech by sending the output signal from the amplifier 9 to a speaker 10.

The following portion of this specification substantially parallels an initial draft of the submitted technical paper "Microphone-Array Speech Enhancement in Background Noise and Overdetermined Signal Scenarios" which is identified as items 3*a* in the list of disclosing publications located early in this Detailed Description topic.

In the following sections I to VII of this technical paper, material the number appearing in brackets [] refer to the references at the end of the specification.

Although the rules of U.S. patent practice preclude a formal incorporation by reference of the other technical papers and documents identified in this specification (and require an actual reproduction of the technical paper or document herein) readers of this specification desiring additional information may of course refer to these technical papers and documents.

I. Introduction

This paper addresses the problem of using a microphone array to enhance speech that has been corrupted by several interference signals and/or additive background noise. By speech enhancement, we mean the suppression of additive background noise and/or interference. The speech enhancement problem arises in many applications including hands-free mobile telephony [1–6], aircraft cockpit communications [6–10], hearing aids [11–13], and enhancement for computer speech-to-text devices [10,14].

Three main considerations guide our approach to this problem. First, we ultimately want a speech enhancement algorithm that performs well for a wide range of interference and noise scenarios, particularly for very low signal-to-noise ratio (SNR) environments. The success of the human auditory system in suppressing interference and noise in many adverse environments motivates us in this regard. Second, we permit some degradation of the desired signal in exchange for additional interference and noise suppression. Ideally, we would like to achieve a high degree of noise suppression without any degradation of the desired signal; however, there are many scenarios for which we have yet to achieve this goal. For these cases, we are willing to accept some degradation of the desired signal if it is accompanied by a large degree of noise suppression; this is especially true for low SNR scenarios. Third, we assume that we have available for processing the outputs from a small number of microphones. In fact, we consider the two-microphone case for most of our work.

We consider only small numbers of microphones for two reasons. The first reason is that, for many applications, either we do not have the space for a large array or we cannot justify the cost of a large number of microphones and the necessary processing hardware. The second reason is that the human auditory system uses only two ears, yet it performs well in a wide range of adverse environments. While it is not our goal to design an array processing structure that is an accurate physiological or psychoacoustical model of auditory processing, we are nonetheless motivated by the success of the human auditory system to consider binaural processing for speech enhancement.

Recently, several researchers have investigated the use of microphone array beamformers for the speech enhancement problem [2–5,13,15–21]. Two of the most common beamforming techniques used for speech enhancement are the delay-and-sum beamformer (DSBF) [2,4,17,18,20–23] and the Frost array (or, equivalently, the generalized sidelobe canceller) [2,3,5,13,15–17,22,24–28]. The DSBF is a non-adaptive beamformer, while the Frost array is an adaptive beamformer (see Section III for overviews of these two beamformers). The DSBF forms its output by aligning the desired signal components of each sensor in time using time delay information for the desired signal and summing the shifted sensor signals to form the output signal; thus, the desired signal components add coherently, while the interference and noise components generally do not. The Frost array forms its output by aligning the desired signal components and adaptively filtering the received signals so as to minimize the output power of the array subject to hard constraints on the array weights. The constraints enforce a fixed array response in the desired signal direction and prevent the array from cancelling the desired signal along with the interference and noise.

The performance of both the DSBF and the Frost array depends on the number of microphones used in the array. In order to achieve a high degree of noise and interference suppression, a DSBF must be physically large and use a large number of microphones [2,3,15,17,18,21]. In contrast, the Frost array has been shown to provide good interference suppression in many environments while using only a small number of microphones [2,17]. However, there are environments for which the Frost array does not perform well. Two examples are: 1) a desired speech signal corrupted by uncorrelated white background noise and 2) a desired speech signal corrupted by interference sources, where the number of microphones, K, minus one is less than the number of interference sources (a situation that we refer to as an "overdetermined" signal scenario).

In the overdetermined case, the Frost array adjusts its beam pattern in order to trade off less attenuation for some signals in exchange for greater attenuation of other, more powerful, signals. The Frost array does this in an attempt to maximize the output SNR subject to hard constraints on the weights [29]. Recently, Kaneda and Ohga [15] proposed softening the weight constraint in the Frost array in order to trade off some signal degradation for additional noise suppression. The technique of [15], however, is based on a stationary noise assumption; it requires measuring the noise during nonspeech segments and fixing the weights during the segments containing the desired speech signal. In addition, it is known that the SNR is not a very good objective speech quality measure [30]; therefore, the Frost array may not yield output speech in overdetermined scenarios with as much improvement as we might at first expect.

Note that we are more likely to encounter overdetermined signal scenarios when we use a small number of sensors. Since we are particularly interested in the K=2 case in this paper, we are quite prone to the performance degradation of the Frost array due to overdetermined signal scenarios.

In this paper, we consider the development of array speech enhancement systems for the background noise and overdetermined signal scenarios for which the Frost array performs poorly. We develop two arrays that we call graphic equalizer arrays. The first graphic equalizer array, which we call the GEQ-I array, performs best for the case of a desired signal in uncorrelated white background noise. The second graphic equalizer array, which we call the GEQ-II array, performs best for the overdetermined case.

In Section VII, we show that a single-microphone noise spectral subtraction (NSS) algorithm (see Section III for a brief overview) [31–36] outperforms both the two-microphone DSBF and the two-microphone Frost array for the cause of a desired speech signal in uncorrelated white background noise. This leads us to extend the NSS algorithm to multiple microphones; we call the resulting array the GEQ-I array.

In Section V, we present the details of the GEQ-I array. The GEQ-I array processing structure consists of delaying the received signals so that the desired signal components add coherently, filtering each of the delayed signals through an analysis filter bank, summing the corresponding channel outputs from the sensors, applying a gain to the channel sums, and combining the weighted channel outputs using a synthesis filter. The unique feature of our extension of the NSS algorithm to multiple microphones is that we no longer need to measure the average noise channel magnitudes over nonspeech regions as is required in the standard NSS technique. Instead, we calculate the gain of the GEQ-I array through the use of cross correlations on the corresponding frequency channels of the various sensors (see Section V). The GEQ-I array is similar to a dereverberation technique originally proposed by Allen, Berkley, and Blauert [37] and later modified by Bloom and Cain [38].

In Section VI, we modify the GEQ-I array to improve speech enhancement in the presence of interfering speech signals; we call this modification the GEQ-II array. The GEQ-II array uses a gain that is parameterized by a frequency-dependent exponent; this gain allows for the desired signal to be degraded in order to achieve additional interference suppression. When we set the exponent to zero for all frequency channels, the GEQ-II array is equivalent to a DSBF. As we increase the exponent for all channels, the GEQ-II array trades off additional signal degradation for additional interference suppression.

In Section VII, we compare the the performance of the GEQ-I and GEQ-II arrays with that of the DSBF and the Frost array. In comparing the performance of the various arrays, we use two objective speech quality measures—namely, the standard SNR and the power function spectral distance (PFSD) measure [30] (see Section IV). Recently, researchers at the Georgia Institute of Technology conducted a ten year study examining the abilities of several speech quality measures to predict diagnostic acceptablity measure (DAM) scores [30]. Of the various basic measures considered in the study, the PFSD measure proved to be one of the best, having a correlation coefficient of 0.72 with DAM scores. The SNR yielded a correlation coefficient no better than 0.31.

II. Problem Statement

Figure 1A:
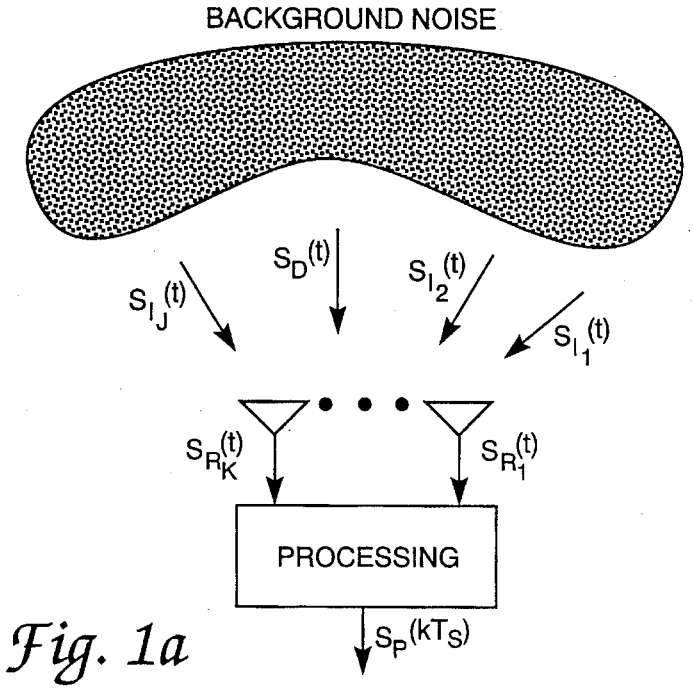
FIG. 1*a* is block diagram of the speech enhancement problem considered herein.

In this section, we outline the speech enhancement problem that we examine in this paper. Consider the signal scenario shown in FIG. 1*a*. An array of K microphones receives a desired speech signal, $s_D(t)$, where the desired source is in the far field of the array. Each sensor also receives some combination of corrupting interference and background noise. The processed signals in the array output suppress the interference and background noise components. The only assumptions that we make concerning the background noise and interference are that the background noise and interference are statistically independent of the desired signal.

After filtering and sampling every $T_s$ seconds, the received signals, $s_{Ri}(kT_s)$, are $$s_{R_i}(kT_S) = s_D(kT_S - \tau_{D,i}) + \sum_{j=1}^{J} \alpha_{I_j,i} s_{I_j}(kT_S - \tau_{I_j,i}) + s_{N_i}(kT_S)$$

for $i = 1, \ldots, K$, where $s_D(kT_s)$ denotes the sampled desired signal $s_{Ij}(kT_s)$ denotes the jth sampled interference signal (j=1, . . . , J)

$s_{Ni}(kT_s)$ denotes the sampled combination of background noise and sensor noise present at the ith sensor $T_{D,i}$ denotes the time delay (TD) of the desired signal at the ith sensor relative to the first sensor ($T_{D,1}=0$)

$T_{Ij,i}$ denotes the TD of the jth interference signal at the ith sensor relative to the first sensor ($T_{Ij,1}=0$ for j=1, . . . , J)

$\alpha_{Ij,i}$ denotes the attenuation or amplification of the jth interference signal at the ith sensor relative to the first sensor ($\alpha_{Ij,1}=1$ for j=1, . . . , J)

The speech enhancement problem that we consider is as follows. Given the signal scenario shown in FIG. 1*a*, process the $s_{Ri}(kT_s)$ signals to produce a single output signal, $s_P(kT_s)$, in which the interference and noise components are suppressed relative to their levels at the sensor inputs. We permit some degradation of the desired signal in exchange for additional interference and noise suppression; however, the amount of signal degradation which we will tolerate depends on the signal-to-noise ratio at the array inputs. We will tolerate more signal degradation in very noisy scenarios and less signal degradation in less noisy scenarios. We want our speech enhancement algorithm to be robust to a wide range of interference and noise scenarios. We do not assume a priori knowledge of the interference and noise scenario, so we do not assume a detailed statistical model for the noise and interference. Finally, we are most interested in very noisy cases where we receive the speech using two microphones (i.e. K=2).

For the work presented in this paper, we assume that we know the time delays (TD's) for the desired signal. There are several scenarios in which we can assume that we know these time delays, especially for the two microphone case (i.e. K=2) [29]. If the TD's are not known, then they can be estimated using, for example, the methods in [29,39,40].

III. Details of Selected Speech Enhancement Algorithms

In this section, we provide an overview of four existing speech enhancement techniques that we refer to in later sections. We discuss the delay-and-sum beamformer (DSBF) and the Frost array in Subsection A. We discuss the noise spectral subtraction (NSS) algorithm in Subsection B and the dereverberation technique of Allen, Berkley, and Blauert (ABB) in Subsection C.

A. Microphone Array Beamformers

Figure 2:
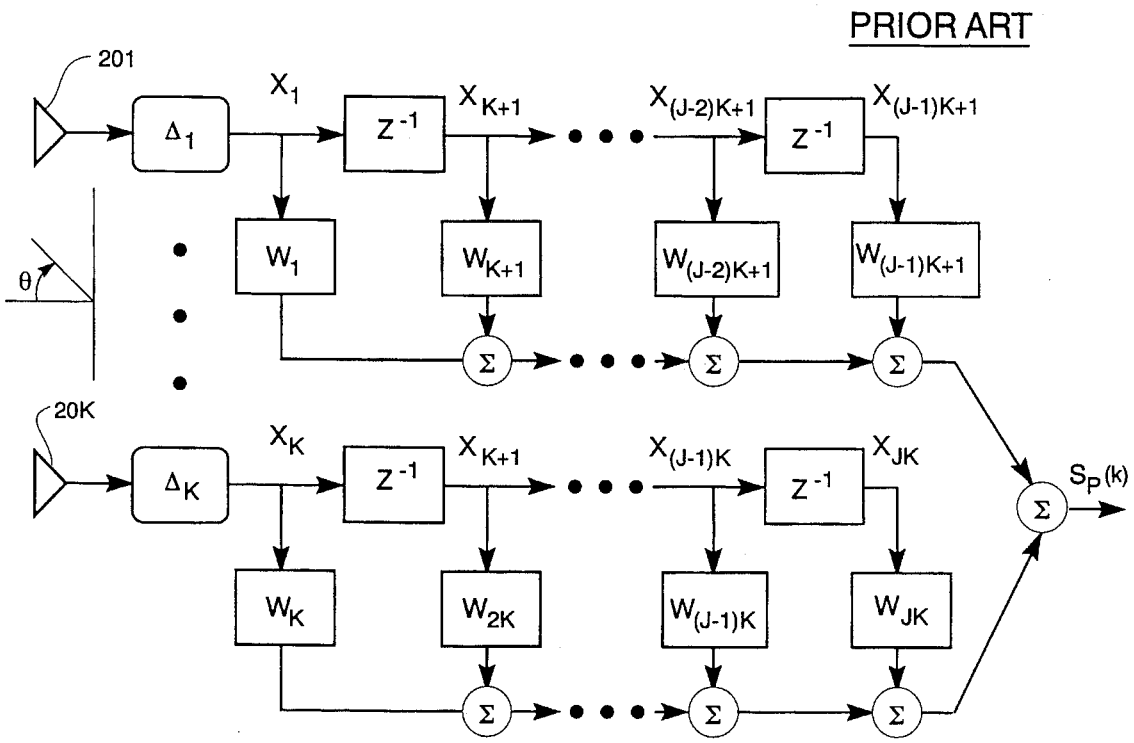
FIG. 2 is diagram of a K-microphone, J-tap array.

FIG. 2 shows a K-microphone, J-tap beamformer, with inputs at microphones 201–20K, inputs which originate from a source offset by the indicated angle θ with respect to the microphone array. The $z^{-1}$ blocks denote delays, the $\omega_i$, i=1, . . . , JK, denote the array weights, and the $\Delta_i$, i=1, . . . , K, denote steering delays. Array beamforming works by spatial filtering. First, we use knowledge of the time delays (TD's) of a desired signal to determine the direction in which to point the array. We steer the array by adjusting the steering delays, $\Delta_i$, i=1, . . . , K, so that the desired signal components in the sensors add coherently. In other words, the $\Delta_i$ are time delays which are set to time-align the desired signal component in each of the sensors. Next, we filter the delayed received signals and sum the filter outputs so as to suppress signals that arrive from directions other than the desired direction.

The DSBF [2,4,17,18,20–23] uses J=1 and $\omega_i$=1/K for i=1, . . . K. Thus, the DSBF simply averages the delayed received signals.

The main idea behind the Frost array is to minimize the output power of the array subject to constraints placed on the weights [2,3,5,13,15–17,22,24–28]. The constraints enforce a fixed array response in the desired signal direction and prevent the array from cancelling the desired signal along with the interference and noise. For signals arriving from the desired direction, the constraints cause the array to operate as a finite impulse response filter with coefficients $f_1, \ldots, f_J$. We write the constraints as $C^T w = f$, where $$w^T = [\omega_1\ \omega_2 \ldots \omega_{JK}],$$

$$f^T = [f_1\ f_2 \ldots f_J],$$

and C is the KJ×J constraint matrix. The optimal weights are functions of the correlation matrix of the data; however, we generally do not have a priori knowledge of the correlation matrix. For this reason, Frost proposed the following adaptive algorithm. Define g and P $$g \triangleq C(C^T C)^{-1} f,$$

$$P \triangleq I - C(c^T C)^{-1} C^T,$$

then the adaptive weight control algorithm is $$w(0) = g,$$

$$w(k+1) = P[w(k) - \mu s_p(k) x(k)] + g,$$

where μ is a constant that controls the adaptation rate.

B. The Noise Spectral Subtraction Technique

Figure 3:
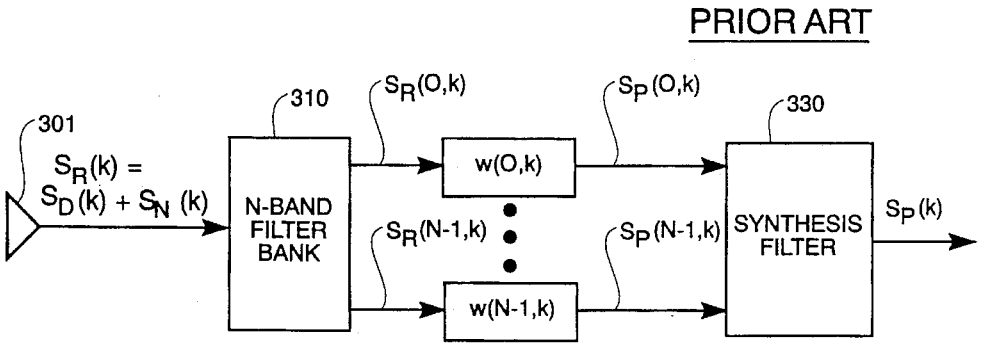
FIG. 3 is a diagram of a single-microphone speech enhancement system based on the idea of analysis/synthesis filtering.

FIG. 3 in the drawings shows a single-microphone speech enhancement system based on the idea of analysis/synthesis filtering. In this system, the w(n,k) weights make $s_P(k)$ "close" to the desired signal, $s_D(k)$, with respect to some quality measure.

In other words, FIG. 3 shows a block diagram of the noise spectral subtraction (NSS) technique [31–36]. A single microphone 301 receives a desired speech signal which has been corrupted by additive noise. Denote the sampled received, desired, and noise signals by $s_R(k)$, $s_D(k)$, and $s_N(k)$, respectively, then $$s_R(k) = s_D(k) + s_N(k).$$

We filter $s_R(k)$ through an N-band analysis filter bank 310 (often the short-time Fourier transform [10,31,32,35,41]) to form the channel signals denoted by the $s_R(n,k)$; here, n denotes the filter number, and k denotes the time. We multiply the channel outputs by the corresponding time-varying weights, ω(n,k). The NSS weights are $$w(n,k) = \begin{cases} \dfrac{[|s_R(n,k)|^{\alpha} - U^{\alpha}(n)]^{1/\alpha}}{|s_R(n,k)|}, & U(n) \leqq |s_R(n,k)| \\ 0, & \text{otherwise} \end{cases} \quad (1)$$

where U(n) is the average noise magnitude for channel n measured during a nonspeech segment and α is a parameter that depends on the method being used. Boll [31] used α=1, while others [32,41] have used α=2. Let $s_P(n,k)$ denote the weighted channel outputs, then $$s_P(n,k) = \omega(n,k) s_R(n,k).$$

We form the processed speech signal by filtering the $s_P(n,k)$ with a synthesis filter 330.

C. The Dereverberation Technique of Allen, Berkley, and Blauert

The dereverberation technique of Allen, Berkley, and Blauert (ABB) [37] is a two-microphone technique that shares many of the characteristics of the single-microphone NSS technique outlined in the previous subsection. Although we are not primarily concerned with the dereverberation problem in this paper, we discuss this technique here, because it is closely related to the algorithms that we introduce in Sections V and VI.

Figure 4:
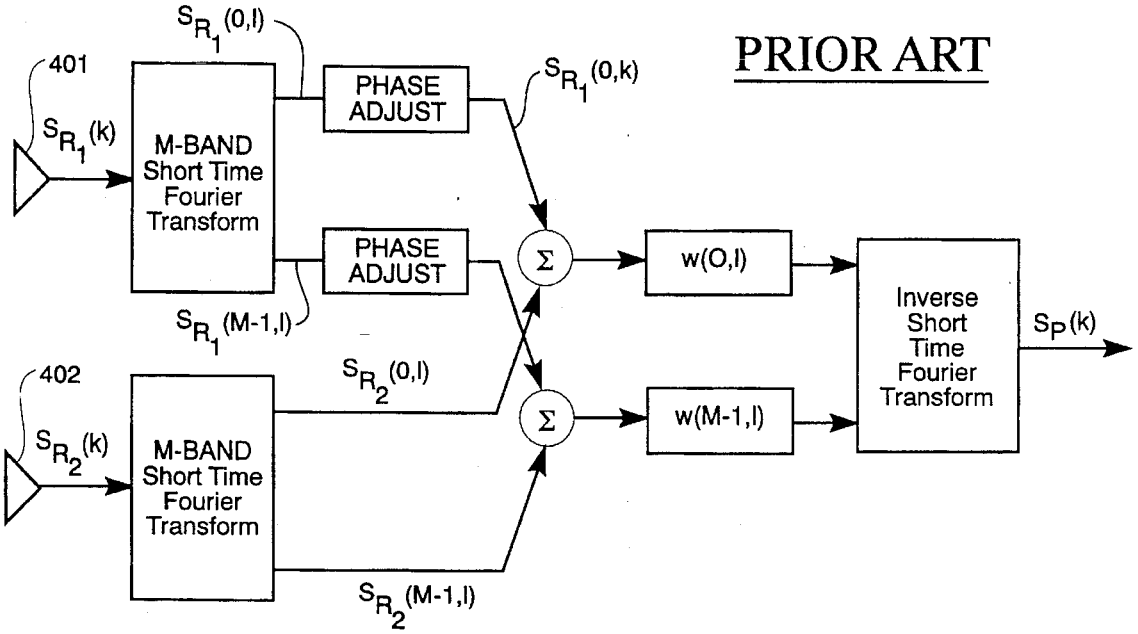
FIG. 4 is a diagram showing the dereverberation technique of Allen, Berkley, and Blauert.

FIG. 4 shows a block diagram of the ABB dereverberation algorithm. The two sampled received signals from microphones 401 and 402 are $s_{R1}(k)$ and $s_{R2}(k)$. We filter each of these two signals through an N-band short-time Fourier transform (STFT) filter bank to form the channel signals denoted by the $s_{Ri}(n,l)$; here, the index n denotes the frequency band number (n=0, . . . , N−1) and the index I denotes the time frame number. We set the phase of $s_{R1}(n,l)$ equal to the phase of $s_{R2}(n,l)$ in order to perform a crude time-alignment. For each n∈{0, . . . , N−1}, we add the phase-adjusted $s_{R1}(n,l)$ to $s_{R2}(n,l)$ and multiply this sum by the weight ω(n,l). Finally, we form the output, $s_P(k)$, by performing an inverse STFT operation on the N weighted channel sums.

Allen et al. proposed the following gain $$w(n,l) = \frac{|\Phi_{12}(n,l)|}{\Phi_{11}(n,l) + \Phi_{22}(n,l)}, \quad (2)$$

where $$\Phi_{11}(n,l) = \overline{|s_{R1}(n,l)|^2},$$

$$\Phi_{22}(n,l) = \overline{|s_{R2}(n,l)|^2},$$

$$\Phi_{12}(n,l) = \overline{s_{R1}(n,l) s^*_{R2}(n,l)},$$

and the overbar indicates a moving average with respect to time.

In [38], Bloom and Cain tested several modifications to the basic ABB algorithm, one of which was a modification to the gain function. They proposed the following gain $$w(n,l) = \left( \frac{|\Phi_{12}(n,l)|}{\sqrt{\Phi_{11}(n,l)\Phi_{22}(n,l)}} \right)^b \quad (3)$$

where b is an adjustable constant set to one or two.

IV. The Power Function Spectral Distance Measure

In this section, we present a brief overview of the power function spectral distance (PFSD) measure. We use the PFSD measure, in addition to the SNR, to quantify the performance of the various speech enhancement algorithms that we consider.

The PFSD measure is one of several speech quality measures examined in [30] and based on processing the outputs of a critical band filter bank. A critical band filter bank filters a speech signal through a bank of bandpass filters with non-uniform spacing of the center frequencies and non-uniform bandwidths. The center frequencies are linearly spaced for low frequencies and roughly logarithmically spaced for mid to high frequencies. The bandwidths are constant for low center frequencies; for mid to high center frequencies, they increase with increasing center frequency.

The calculation of the PFSD centers around the short-time root-mean-square (STRMS) values of the critical band filter outputs. Let $s_P(k)$ be a processed speech signal, and let $s_D(k)$ be the desired speech signal. Let $s_P(m,k)$ denote the output of the mth critical band filter at time k given $s_P(k)$ as the filter input, and let $R_P(m,l)$ denote the STRMS value of the output of the mth critical band filter over the lth time frame given $s_P(k)$ as the filter input. We calculate the STRMS values of $s_P(k)$ using an L-point Hamming window as follows $$R_P(m,l)=\left(\frac{\sum_{k=-\lfloor\frac{L-1}{2}\rfloor}^{L-\lfloor\frac{L-1}{2}\rfloor-1} w_H(k)s_P^2(m,lQ+k)}{\sum_{k=-\lfloor\frac{L-1}{2}\rfloor}^{L-\lfloor\frac{L-1}{2}\rfloor-1} w_H(k)}\right)^{\frac{1}{2}}, \quad (4)$$

where $\omega_H(k)$ denotes the Hamming window, and Q is the step size controlling the degree of overlap in the time frames. In [30], L was chosen to give a 20 msec window length, and Q was chosen to give a 10 msec overlap in the time frames. Let $s_D(m,k)$ denote the output of the mth critical band filter at time k given $s_D(k)$ as the filter input, and let $R_D(m,l)$ denote the STRMS value of the output of the mth critical band filter over the lth time frame given $s_D(k)$ as the filter input. We calculate the $R_D(m,l)$ values in a manner analogous to the calculation of the $R_P(m,l)$ values given in Equation (4). We calculate the PFSD from the $R_P(m,l)$ and $R_D(m,l)$ values as follows. Let $d(s_P(k),s_D(k))$ denote the PFSD from $s_P(k)$ to $s_D(k)$, then $$d(s_P(k), s_D(k))=\frac{1}{MN_l}\sum_{l=0}^{N_l-1}\sum_{m=0}^{M-1}|R_P^{0.2}(m,l)-R_D^{0.2}(m,l)|, \quad (5)$$

where $N_l$ is the total number of time frames over which the measure is to be calculated, and M is the number of filters in the critical band filter bank. We use speech sampled at 16 kHz, so we need M=33 filters to cover the 8 kHz bandwidth of the signals [29]. The power of 0.2 applied to the STRMS values in Equation (5) was found in [30] to give the highest degree of correlation with DAM scores of any of the powers tried.

V. The GEQ-I Array

In this section, we present the details of the GEQ-I array. In Section VII, we show that a single-microphone NSS algorithm outperforms both the two-microphone DSBF and the two-microphone Frost array for the case of a desired speech signal in uncorrelated white background noise provided that the input SNR is low. This result motivates us to consider extending the NSS algorithm to multiple microphones. A very straightforward way to make this extension is to use a K-microphone DSBF followed by a single-microphone, N-channel NSS algorithm. Such a structure requires that we measure the average noise channel magnitude over nonspeech segments; however, very noisy scenarios could make this problem difficult in practice [35]. One solution to the problem of extending NSS-type algorithms to multiple microphones lies in using a gain that is a function of the cross correlations and autocorrelations among the various microphone signals; this approach forms the basis of the GEQ-I array.

Figure 5:
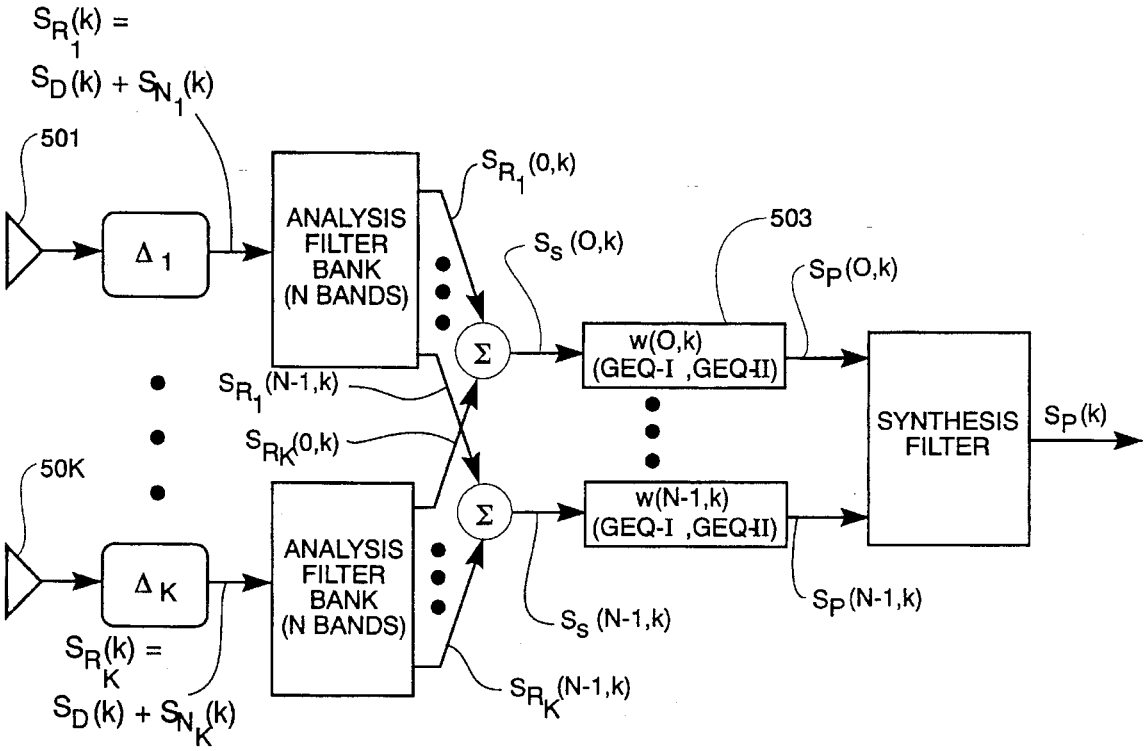
FIG. 5 is a block diagram of the K-element, N-channel GEQ-I and GEQ-II arrays.

Consider the K-microphone, N-channel structure shown in FIG. 5. Each microphone 501–50K receives some combination of a desired signal and a component due to noise and/or interference. We delay the ith received signal by an amount $\Delta_i$, so that the shifted desired signal components add coherently. We then sample the shifted received signals to form the $s_{Ri}(k)$ signals for i=1, . . . , K. We filter the sampled signals from each sensor with an N-band analysis filter bank to form the channel output signals, $s_{Ri}(n,k)$, for i=1, . . . , K and n=0, . . . , N−1, where the index n denotes the channel number. Denote as $s_D(n,k)$ the desired signal component filtered by the nth analysis filter, and denote as $s_{Ni}(n,k)$ the corresponding filtered noise and interference component for the ith sensor. We then have $$s_{Ri}(n,k)=s_D(n,k)+s_{Ni}(n,k) \quad (6).$$

We sum the corresponding channel signals from each sensor to form the $s_S(n,k)$ signals as $$s_S(n,k)=\sum_{i=1}^{K} s_{R_i}(n,k). \quad (7)$$

At this point, the array acts as a bank of narrowband DSBF's. To the $s_S(n,k)$ signals, we apply a channel-dependent gain function, $\omega(n,k)$, (at 503 etc. in FIG. 5) in order to form the weighted channel signals, $s_P(n,k)$. Thus, we have $$s_P(n,k)=\omega(n,k)s_S(n,k)$$

for each n and k. Finally, we filter the weighted channel signals with an N-input, single-output synthesis filter to form the processed speech signal, $s_P(k)$. We have two main issues to resolve with this processing structure—namely, the choice of the analysis/synthesis (A/S) filter bank pair and the choice of the gain function.

The GEQ-I array employs the short-time discrete cosine transform (STDCT) [42–44] as the A/S filter bank. While other A/S filter banks could be used, the STDCT offers a number of advantages over other A/S filter banks. Of primary importance is that the STDCT is computationally efficient and, because it avoids the use of complex numbers, requires less memory and addition/multiplies than some filter banks that use complex numbers. Of secondary interest to us is the fact that the STDCT structure makes it easy to change the number of filters, which is useful in comparing the performance of the GEQ-I array for various numbers of filters and filter bandwidths.

The STDCT consists of calculating the discrete cosine transform (DCT) over successive windowed data segments. We apply an N-point rectangular window to the data, calculate the DCT for the windowed data, slide the window by one data point, calculate the next DCT, and so on. Since we use a rectangular window and slide the window one data point at a time, it turns out that we can easily write the kth DCT in terms of previous DCT's [44,29]. For a sequence of data denoted by x(k), let the kth data segment consist of the data points $$x\left(k-\lfloor\frac{N-1}{2}\rfloor\right),\ldots,x\left(k+N-\lfloor\frac{N-1}{2}\rfloor-1\right),$$

where [●] denotes the floor operator. (The floor operator [x] returns the greatest integer less than or equal to ω. Thus, [5.5]=5.) Denote the N DCT coefficients for the kth data segment by $X_0(k), \ldots, X_{N-1}(k)$. The direct form of the kth DCT is [42–44]

$$X_0(k) = \frac{\sqrt{2}}{N}\sum_{m=-\lfloor\frac{N-1}{2}\rfloor}^{N-\lfloor\frac{N-1}{2}\rfloor-1} x(k+m),$$

$$X_n(k) = \frac{2}{N}\sum_{m=-\lfloor\frac{N-1}{2}\rfloor}^{N-\lfloor\frac{N-1}{2}\rfloor-1} x(k+m)\cos\left(\frac{\pi n\left[2\left(m+\lfloor\frac{N-1}{2}\rfloor\right)+1\right]}{2N}\right),$$

$$n=1,\ldots,N-1.$$

Let $$\tilde{X}_0(k) \triangleq \frac{N}{\sqrt{2}} X_0(k),$$

$$\tilde{X}_n(k) \triangleq \frac{N}{2\cos\left(\frac{\pi n}{2N}\right)} X_n(k), \quad n=1,\ldots,N-1,$$

then we have [29]

$$\begin{aligned}\tilde{X}_0(k) &= \tilde{X}_0(k-1) + x\left(k+N-\lfloor\frac{N-1}{2}\rfloor-1\right) - x\left(k-\lfloor\frac{N-1}{2}\rfloor-1\right)\\ \tilde{X}_n(k) &= 2\cos\left(\frac{\pi n}{N}\right)\tilde{X}_n(k-1) - \tilde{X}_n(k-2) + x\left(k-\lfloor\frac{N-1}{2}\rfloor-2\right) - x\left(k-\lfloor\frac{N-1}{2}\rfloor-1\right) + (-1)^n\left[x\left(k+N-\lfloor\frac{N-1}{2}\rfloor-1\right) - i\,x\left(k+N-\lfloor\frac{N-1}{2}\rfloor-2\right)\right]\end{aligned}$$

We form the inverse STDCT as $$x(k) = \frac{1}{N}\tilde{X}_0(k) + \sum_{n=1}^{N-1}\tilde{X}_n(k)\left[\frac{2}{N}\cos\left(\frac{\pi n}{2N}\right)\cos\left(\frac{\pi n\left[2\lfloor\frac{N-1}{2}\rfloor+1\right]}{2N}\right)\right].$$

We now consider a way to combine the outputs of the STDCT's of the received signals in order to compute a channel-dependent gain.

Suppose that we set the weights of FIG. 5 to be the NSS weights with $\alpha=1.0$ (see Equation (1)), then the weighted channel signals, $s_P(n,k)$, are $$s_P(n,k) = \frac{[|s_S(n,k)| - U(n)]\, s_S(n,k)}{|s_S(n,k)|}, \tag{8}$$

provided that $s_S(n,k)\neq 0$ and $U(n)\leqq|s_S(n,k)|$, where U(n) is the average noise magnitude for the nth channel. By setting the weighted channel signals as in Equation (8), we attempt to set the magnitude of $s_P(n,k)$ equal to the magnitude of $s_D(n,k)$. The $[|s_S(n,k)|-U(n)]$ factor in the numerator of Equation (8) is an estimate of $m_D(n,k)=|s_D(n,k)|$; however, it is not the only possible estimate.

Define $\Phi_{ij}(n,k)$ as $$\begin{aligned}\Phi_{ij}(n,k) &\triangleq \sum_{m=-\lfloor\frac{N_C-1}{2}\rfloor}^{N_C-\lfloor\frac{N_C-1}{2}\rfloor-1} s_{R_i}(n,k+m)s_{R_j}(n,k+m),\\ &= \sum_{m=-\lfloor\frac{N_C-1}{2}\rfloor}^{N_C-\lfloor\frac{N_C-1}{2}\rfloor-1} [s_D^2(n,k) + s_D(n,k)s_{N_i}(n,k) + s_D(n,k)s_{N_j}(n,k) + s_{N_i}(n,k)s_{N_j}(n,k)]\end{aligned} \tag{9}$$

for some $i,j \in\{1,\ldots,K\}$ such that $i\neq j$, where $N_C$ is a parameter to be chosen. If $m_D(n,k)$ changes slowly over small time intervals of length $N_C$, then one estimate of $m_D(n,k)$ is $$\hat{m}_D(n,k) = \left|\frac{2}{N_C K(K-1)}\sum_{i=1}^{K-1}\sum_{j=i+1}^{K}\Phi_{ij}(n,k)\right|^{\frac{1}{2}} \tag{10}$$

We form the GEQ-I gain by dividing $\hat{m}_D(n,k)$ by an estimate of $|s_S(n,k)|$. Define $\Phi_{SS}(n,k)$ as $$\Phi_{SS}(n,k) \triangleq \sum_{m=-\lfloor\frac{N_C-1}{2}\rfloor}^{N_C-\lfloor\frac{N_C-1}{2}\rfloor-1} s_S^2(n,k+m). \tag{11}$$

If $|s_S(n,k)|$ changes slowly over time frames of length $N_C$, then $$|s_S(n,k)| \approx \left|\frac{1}{N_C}\Phi_{SS}(n,k)\right|^{\frac{1}{2}}$$

We thus form the GEQ-I gain as $$w(n,k) = \begin{cases}\left(\dfrac{\frac{2}{K(K-1)}\left|\sum_{i=1}^{K-1}\sum_{j=i+1}^{K}\Phi_{ij}(n,k)\right|}{\Phi_{SS}(n,k)}\right)^{\frac{1}{2}}, & \Phi_{SS}(n,k)\neq 0\\ 0, & \Phi_{SS}(n,k)=0\end{cases}$$

The GEQ-I gain is similar to the gain used in the ABB algorithm [37] for dereverberation (see Equation (2)). For the K=2 case (i.e. for the two-microphone case), $$\Phi_{SS}(n,k)=\Phi_{11}(n,k)+2\Phi_{12}(n,k)+\Phi_{22}(n,k),$$

and the GEQ-I gain is $$w(n,k) = \left|\frac{\Phi_{12}(n,k)}{\Phi_{11}(n,k)+2\Phi_{12}(n,k)+\Phi_{22}(n,k)}\right|^{\frac{1}{2}}$$

Comparing this gain to the gain in Equation (2), we see that the GEQ-I gain has a $\Phi_{12}(n,k)$ term in the denominator that the ABB gain does not have. Also, the GEQ-I gain applies a square root to the fraction that the ABB gain does not apply. However, both gains are based on cross correlations and autocorrelations between the corresponding channels of the various sensors, both gains use $|\Phi_{12}(n,k)|$ as the numerator term, and both gains use autocorrelations in the denominator. The GEQ-I gain uses an autocorrelation of the $s_S(n,k)$ signals of FIG. 5, while the technique of Allen et al. uses autocorrelations of the channel outputs of both the first and second sensors.

We make one final point concerning the GEQ-I gain. We can reduce the computational complexity of the GEQ-I gain by computing the correlations of Equations (9) and (11) recursively as $$\Phi_{ij}(n,k) = \Phi_{ij}(n,k-1) + s_{R_i}\left(n,k+N_C-\left\lfloor\frac{N_C-1}{2}\right\rfloor-1\right)s_{R_j}\left(n,k+N_C-\left\lfloor\frac{N_C-1}{2}\right\rfloor-1\right)-s_{R_i}\left(n,k-\left\lfloor\frac{N_C-1}{2}\right\rfloor-1\right)s_{R_j}\left(n,k-\left\lfloor\frac{N_C-1}{2}\right\rfloor-1\right)$$

$$\Phi_{SS}(n,k) = \Phi_{SS}(n,k-1) + s_S^2\left(n,k+N_C-\left\lfloor\frac{N_C-1}{2}\right\rfloor-1\right)-s_S^2\left(n,k-\left\lfloor\frac{N_C-1}{2}\right\rfloor-1\right)$$

VI. The GEQ-II Array

In this section, we present the details of the GEQ-II array. As we illustrate in the next section, the performance gain of the GEQ-I array diminishes in the presence of interfering speakers. This diminished performance is due to the fact that the interference causes the $s_{Ni}(n,k)$ and $s_{Nj}(n,k)$ sequences of Equation (6) to be nonwhite and highly correlated with each other. These highly correlated sequences cause the channel cross corelations, $\Phi_{ij}(n,k)$, of Equations (9) and (10) to have large cross terms, and thus, to be poor estimates of the channel magnitudes, $|s_D(n,k)|$, of the desired speech signal. In this section, we modify the GEQ-I gain to address this problem; this leads to the GEQ-II array. We use the GEQ-I array processing structure (see FIG. 5) for the GEQ-II array, but with a different gain.

We modify the GEQ-I gain to get the GEQ-II gain as follows $$w(n,k) = \begin{cases} \frac{1}{K}\left|\dfrac{\sum_{i=1}^{K-1}\sum_{j=i+1}^{K}\Phi_{ij}(n,k)}{\sum_{i=1}^{K-1}\sum_{j=i+1}^{K}\sqrt{\Phi_{ii}(n,k)\Phi_{jj}(n,k)}}\right|^{b(n)}, & \sum_{i=1}^{K-1}\sum_{j=i+1}^{K}\sqrt{\Phi_{ii}(n,k)\Phi_{jj}(n,k)} \neq 0 \\ 0, & \text{otherwise} \end{cases}$$

where b(n) is a channel-dependent exponent. The 1/K factors simply scale the output so that the desired signal component has the proper magnitude; we can incorporate the 1/K factors into the synthesis filter bank parameters in order to reduce computation. We absorb the exponent of ½ from the original GEQ-I gain in the definition of b(n). In the discussion which follows, we refer to the quantities inside the absolute value signs as generalized correlation coefficients (GCC).

The GEQ-II array behaves as follows. If the GCC for a particular channel and time frame is very close to one, then it is an indication that the noise in the channel is weak relative to the desired signal component in the channel and that we should pass the time-frequency bin to the output relatively unattenuated. If the GCC for a particular channel and time frame is close to zero, then it is an indication that the desired signal component in the channel is weak relative to the noise in the channel and that we should greatly attenuate the time-frequency bin. The channel-dependent exponent, b(n), controls the behavior of the GEQ-II gain for GCC's between these two extremes. If we choose b(n) to be zero for all n, then all of the weights are equal to one, and the GEQ-II array is equivalent to the DSBF. In this case, the GEQ-II array passes the desired signal through to the output with no degradation; however, the only noise reduction is that due to the DSBF portion of the array. On the other hand, if we choose b(n) to be very large for all n, then the weights will be close to zero, and the array will be nearly turned off. In this case, the array greatly attenuates the noise; however, it also greatly degrades the desired signal. Thus, we use b(n) to trade off additional signal degradation for additional noise suppression, since it controls how close a GCC has to be to one in order to be indicative of a time-frequency bin that should be passed to the output relatively unattenuated. We show in [29] that b(n) also controls the sensitivity of the GEQ-II array to time delay (TD) estimation errors; low b(n) values yield less sensitivity to TD errors than do high b(n) values.

In addition to being closely related to the DSBF, the GEQ-II array is closely related to the ABB algorithm as modified by Bloom and Cain [38] (see Section III). Bloom and Cain suggested a gain function equivalent to the GEQ-II gain for the K–2 microphone case, except that they fixed b(n)=2 for all n.

VII. Examples

In this section, we present experimental results that illustrate several characteristics of the GEQ-I and GEQ-II arrays. Note that the PFSD is a distance measure, so lower PFSD values indicate better performance, whereas higher SNR values indicate better performance.

A. White-Noise Example

In this example, we consider a set of cases in which a two-microphone array receives a desired speech signal that is corrupted by zero-mean white Gaussian noise. The noise is uncorrelated with the desired signal and uncorrelated from sensor to sensor. The desired signal has an arrival angle, θ, of 0° (see FIG. 2 for the definition of θ); thus, the desired signal arrives at both sensors at the same time and with the same amplitude. The desired speech signal is the TIMIT database sentence "Don't ask me to carry an oily rag like that." spoken by a male and sampled at 16 kHz. We consider this signal scenario for several noise levels.

Before we compare the performance of the various algorithms, we set the parameters of the algorithms. We set the weights of the Frost array to their optimal values for the white noise scenario (see [29]); for this setting of the weights, the Frost array is equivalent to a DSBF [29]. It is easy to show that the DSBF/Frost array yields a 3 dB improvement in the SNR for this case [29].

For the NSS algorithm, we set α=1.0 (see Equation (1)), and we use a 512-channel analysis/synthesis filterbank based on the short-time discrete cosine transform (see Sections III and V). We have previously determined that the desired speech data file has a nonspeech segment for the first 2000 data points (125 msec), so we compute the average noise magnitude for each channel over this time segment (see Equation (1)). We use these average noise channel magnitudes in the subtraction process for the entire speech data file.

We tune the parameters of the GEQ-I array in order to achieve the best performance with respect to both the PFSD and the SNR. Using an input SNR of 1.7 dB, we find that setting the correlation length to $N_C$=281 (see Equation (9)) and the number of channels to N=8 yields the best performance in terms of both the SNR and the PFSD.

We also tune the $N_C$ and N parameters of the GEQ-II array using the 1.7 dB input SNR case. We find that the GEQ-II array performs best with respect to both the PFSD and the SNR for large numbers of frequency channels and small correlation lengths. For this reason, we use $N_C$=21 and N=512 for the GEQ-II array parameters for the remainder of this example.

Using the settings of $N_C$=21 and N=512, we examine the effects of the channel-dependent gain exponent, b(n), on the performance of the GEQ-II array for various input SNR's. We consider two forms for the exponent: (1) $b(n)=B/f_n$, where B is a constant and $f_n$ is the center frequency of the nth channel in Hertz, and (2) b(n)=B (i.e. b(n) is constant with respect to channel number). For both forms of b(n), we find that large values of B yield the best performance in the low input SNR cases, while small values of B yield the best performance in the high input SNR cases. In the remainder of this example, we use these two different forms of the channel-dependent gain exponent. We adjust the B parameter in both exponent forms for each input SNR case to give either the minimum PFSD (for the PFSD plot) or the maximum SNR (for the SNR plot).

Figure 6A:
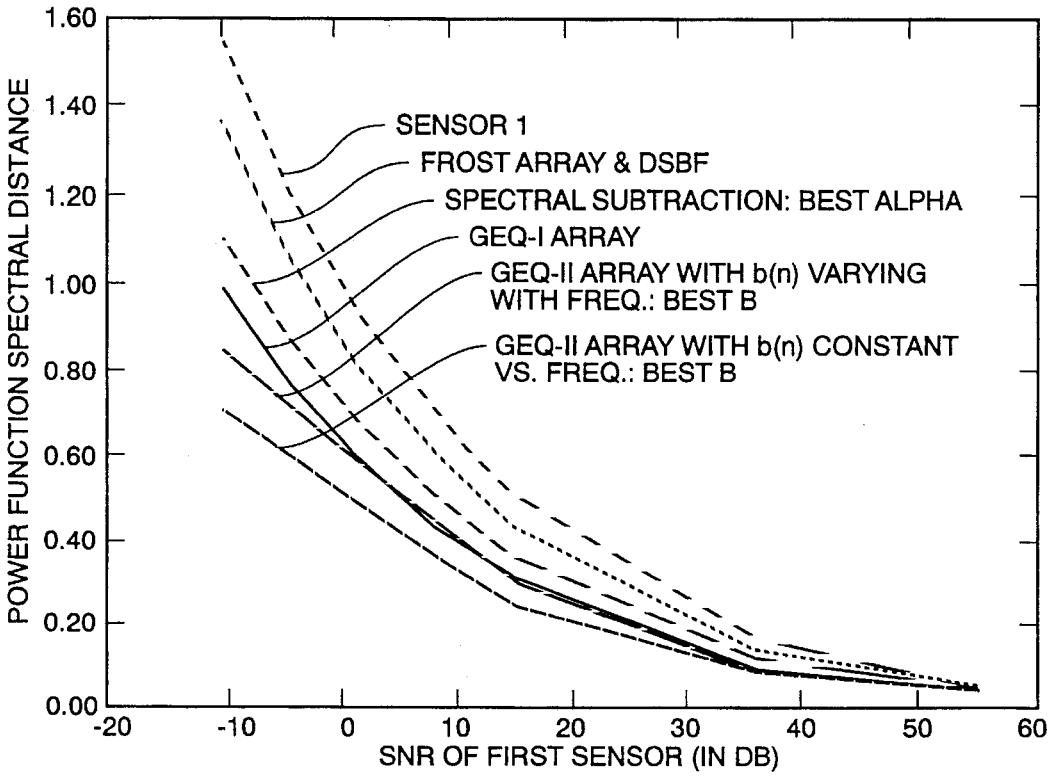
FIGS. 6*a* and 6*b* are graphs of best (6*a*) PFSD and (6*b*) SNR gain of the various algorithms for the white-noise scenario over a wide range of input SNR's.
Figure 6B:
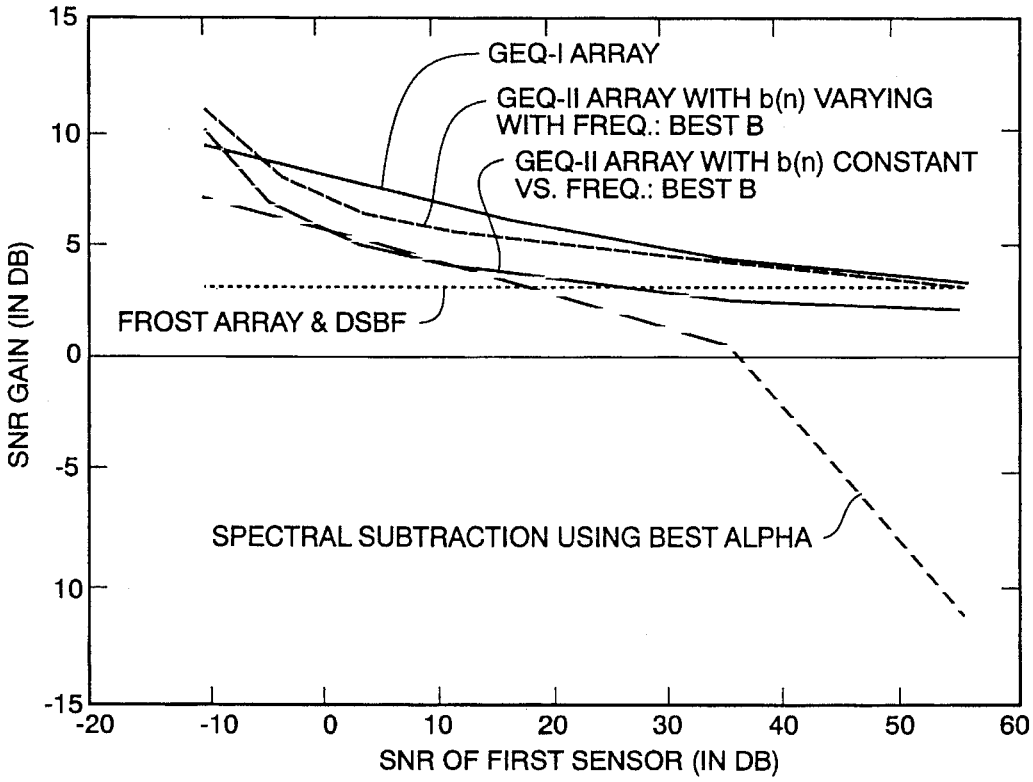

FIG. 6 shows the performance of the various algorithms in terms of the PFSD measure and the gain in SNR. The results as indicated by the PFSD measure are that the GEQ-II array with b(n) constant over frequency generally performs the best, followed by the GEQ-II array with $b(n)=B/f_n$, the GEQ-I array, the NSS algorithm, and the DSBF/Frost array in that order. The results as indicated by the SNR gain are as follows. The DSBF/Frost array suppresses the noise by 3 dB for all input SNR's just as we expect. The NSS algorithm yields speech that is worse than the orginal speech for input SNR's down to about 37 dB. Below an input SNR of 37 dB, the NSS algorithm improves the SNR by an additional 1.6 dB for every 10 dB drop in the input SNR. The NSS algorithm outperforms the DSBF/Frost array for input SNR's below about 17 dB. The GEQ-I array improves the SNR by slightly more than 3 dB for high input SNR levels and by almost 10 dB for low SNR levels. The GEQ-II array using a constant b(n) across frequency channels performs only slightly worse than does the GEQ-I array over most input SNR's, and it performs better than the GEQ-I array for input SNR's below −5 dB. The GEQ-II array using $b(n)=B/f_n$ yields about 1.5 dB less improvement in the SNR than does the GEQ-II array using a constant b(n). The GEQ-II array using $b(n)=B/f_n$ performs worse than does the DSBF/Frost array for input SNR's above 28 dB.

When we listen to the enhanced speech from the various algorithms, we find that the PFSD measure and the SNR do not yield a complete picture of algorithm performance. The performance of each algorithm depends on two factors—namely, (1) the amount and character of the noise suppression and (2) the amount and character of the desired signal degradation. The DSBF/Frost array yields no desired signal degradation but suppresses the background noise only slightly. The GEQ-I array yields more noise suppression than does the DSBF/Frost array with little additional signal degradation. The GEQ-II array using a constant b(n) yields more signal degradation than does the GEQ-I array but with more noise suppression, particularly for high frequencies. The GEQ-II array using $b(n)=B/f_n$ yields more signal degradation than does the GEQ-II array using a constant b(n), especially in the low frequencies, and it leaves a distinct high frequency noise residual.

B. Three-Source Example

In this example, we consider a set of cases in which a two-microphone array with a 2 cm sensor spacing receives three speech signals. These cases are overdetermined, so we expect that the Frost array will not perform well for at least some of the cases. The desired signal is the same as in the previous example—namely, "Don't ask me to carry an oily rag like that." The first interference signal is the TIMIT database sentence "She had your dark suit in greasy wash water all year." spoken by a female. The second interference signal is the TIMIT database sentence "Growing well-kept gardens is very time-consuming." spoken by a male. We fix the arrival angle of the desired signal at 0° and the arrival angle of the second interference signal at −40°, while we step the arrival angle of the first interference signal, $\theta_1$, from −90° to 90° in 10° increments. The SNR of the received signal at the first sensor is −6.19 dB, while the power function spectral distance (PFSD) is 0.707. Note that, for the $\theta_1$=0° case, the first interference source appears to the arrays to be part of the desired signal; thus, any performance gain by any of the arrays should arise solely from suppression of the second interference signal. Also, note that, for the $\theta_1$=−40° case, both interference signals arrive from the same direction; thus, all algorithms operate as if there is only one interference signal coming from this direction.

Using the case with $\theta_1$=10°, we tune the parameters of the Frost array in order to achieve the best performance in terms of the PFSD measure and the SNR. In all cases, we set the constraints on the weights so that the Frost array appears as an all-pass filter to the desired signal; we do this by setting the $f_1, \ldots f_J$ (see Section III) as $$f_i = \begin{cases} 1, & \text{if } i = \lfloor \frac{J}{2} \rfloor \\ 0, & \text{otherwise} \end{cases}$$

Both the PFSD measure and the SNR indicate that the best setting for J is J=64. The PFSD measure indicates that the best setting for $\mu$ is $2\times10^{-8}$, while the SNR indicates that the best setting for $\mu$ is $5\times10^{-8}$; we use these settings for the respective plots in the remainder of this example.

Using the $\theta_1$=10° case, we tune the parameters of the GEQ-I array in the same manner as we tuned the parameters of the Frost array. However, after trying several different values of the correlation length, $N_C$, in the range of 21 to 281 and several different values of the number of frequency channels, N, in the range of 8 to 512, we find that none of the parameter settings results in a PFSD lower than 0.653 or a SNR higher and −6.12 dB. In fact, all of the settings in these ranges yield approximately the same performance. The setting of $N_C$=281 and N=256 yields marginally better results in terms of the PFSD measure, so we use these settings for the GEQ-I array in the remainder of this example.

Using the $\theta_1$=10° case, we tune the parameters of the GEQ-II array. We use a channel-dependent gain exponent of the form $b(n)=B/f_n$, where B is an adjustable parameter and $f_n$ is the center frequency in Hertz for the nth channel. We obtain $B=3.5\times10^5$, $N_C$=21, and N=512 as the best setting with respect to both minimizing the PFSD and maximizing the SNR.

Figure 7A:
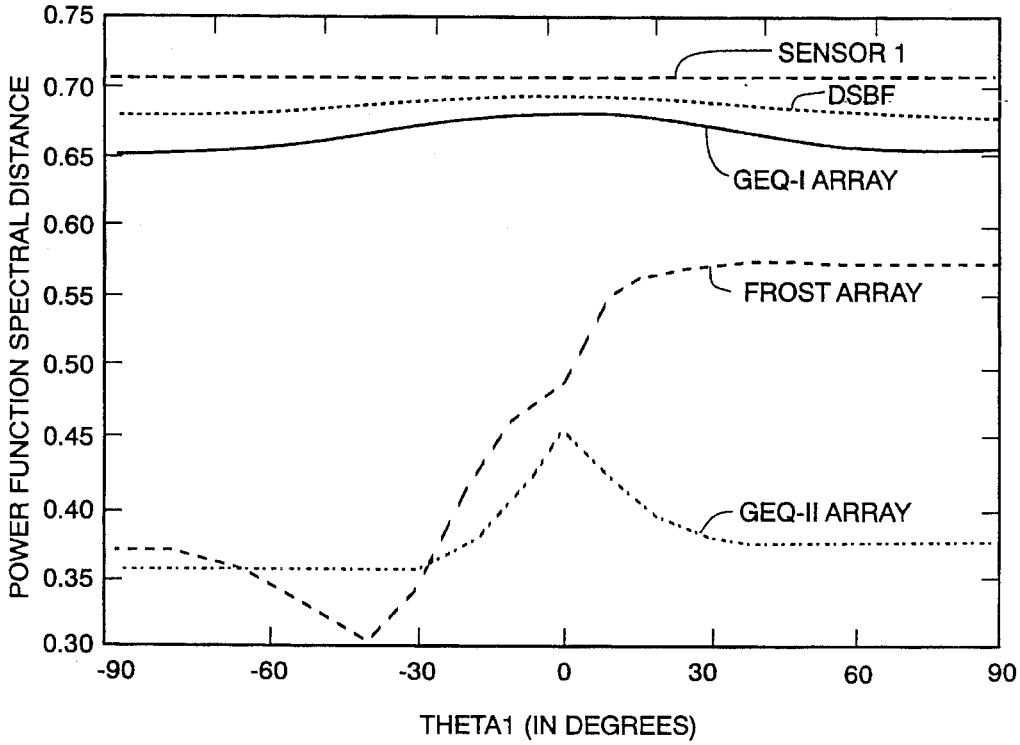
FIGS. 7*a* and 7*b* are graphs of (a) PFSD and (b) SNR of the various algorithms for the three-source scenario over a wide range of arrival angles for the first interference source.
Figure 7B:
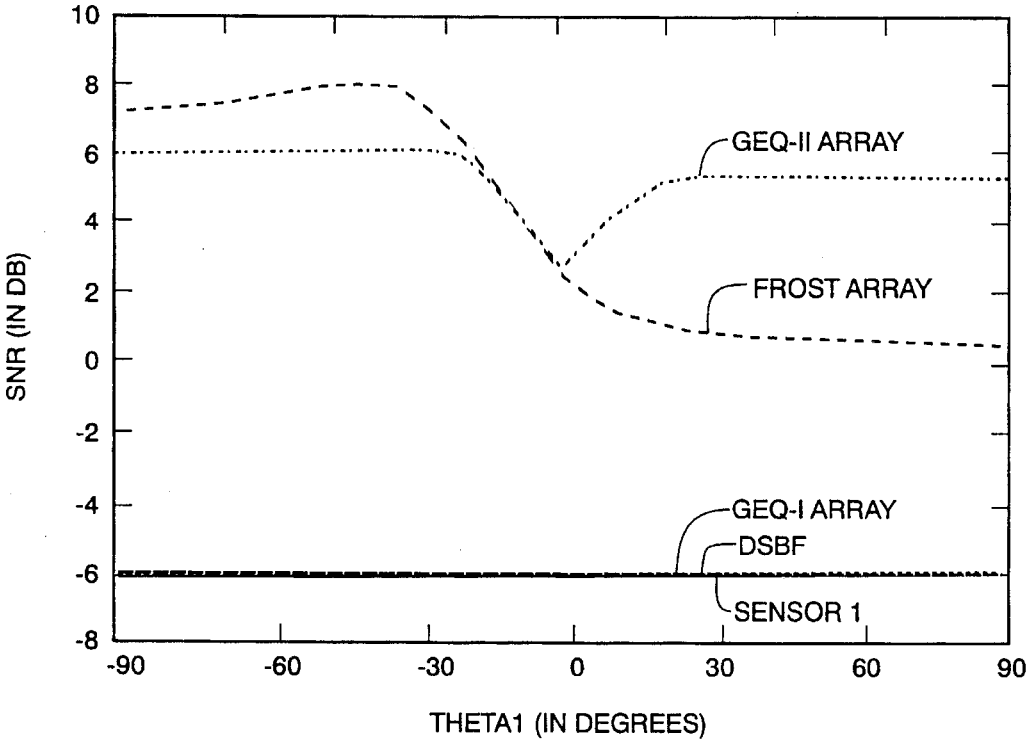

With the Frost array, GEQ-I array, and GEQ-II array parameters set, we compare the performance of these arrays, as well as the performance of the DSBF, for the three-source case versus $\theta_1$. FIG. 7 shows the performance of the four arrays in terms of the PFSD measure and the SNR versus the value of $\theta_1$. We see that both the DSBF and the GEQ-I array perform poorly over the entire range of $\theta_1$. The GEQ-I array yields a PFSD no better than 0.653 and an improvement in the SNR of at most 0.10 dB. The DSBF yields a PFSD no better than 0.677 and an improvement in the SNR of at most 0.06 dB. These two arrays perform poorly because of the high degree of correlation between the interference components in the two sensors. The performance of the GEQ-II array relative to that of the Frost array depends on the value of $\theta_1$. The Frost array performs well for the $\theta_1=-40°$ case, since this scenario does not appear to the array as an overdetermined scenario. For this case, the Frost array yields a PFSD of 0.304 and an improvement in the SNR of 14.31 dB. For values of $\theta_1>0°$, the performance of the Frost array degrades to the point where, for $\theta_1=90°$, the Frost array yields a PFSD of only 0.575 and an improvement in the SNR of only 6.85 dB. The GEQ-II array consistently yields a PFSD no higher than 0.358 for values of $\theta_1$ in the range of $-90°\leqq\theta_1\leqq-30°$ and a PFSD no higher than 0.381 for values of $\theta_1$ in the range of $30°\leqq\theta_1\leqq90°$; the GEQ-II array improves the SNR by at least 12.27 dB for values of $\theta_1$ in the range of $-90°\leqq\theta_1\leqq-30°$ and by at least 11.58 dB for values of $\theta_1$ in the range of $30°\leqq\theta_1\leqq90°$. Thus, we see that the Frost array yields more improvement in the PFSD and the SNR than does the GEQ-II array for those cases in which the interference signals are closely spaced.

When we listen to the outputs from the various algorithms, we note several features of the resulting speech. Both the DSBF and the GEQ-I arrays yield almost no suppression of the interference for any value of $\theta_1$. The performance of the Frost array depends considerably on the value of $\theta_1$. The Frost array yields very good interference suppression with no desired signal degradation for the $\theta_1\leqq-20°$ cases. For the $-20°<\theta_1<10°$ cases, the Frost array suppresses the second interference source, but the words from the first interference source are clearly audible. For the $10°\leqq\theta_1$ cases, the Frost array suppresses the interference only a small amount; thus, the words from the interfering speakers are still clearly audible. The GEQ-II array provides very good interference suppression over the ranges $-90°\leqq\theta_1<-10°$ and $10°<\theta_1\leqq90°$. Over these ranges of $\theta_1$, the words from the competing speakers are only slightly audible. Over the range $-10°\leqq\theta_1\leqq10°$, the GEQ-II array provides only a small amount of interference suppression. For all values of $\theta_1$, the GEQ-II array degrades the desired speech, resulting in a synthetic-sounding signal; however, the desired speech is still quite intelligible.

Taking all of the PFSD measure, SNR, and listening results into account, we find that the GEQ-II array outperforms the Frost array for those cases in which the interference signals are widely spaced, but the Frost array outperforms the GEQ-II array for those cases in which the interference signals are closely spaced. The DSBF and the GEQ-I array perform poorly over all of the scenarios in this section.

VIII. Conclusions

We have developed two two-microphone speech enhancement algorithms based on weighting the channel outputs of an analysis filter bank applied to each of the sensors and synthesizing the processed speech from the weighted channel signals. We call these two techniques the GEQ-I and GEQ-II arrays. Both algorithms use the same basic processing structure, but with different weighting functions; however, cross correlations between corresponding channel signals from the various sensors play a central role in the calculation of both gains.

The GEQ-I and GEQ-II arrays are related to the noise spectral subtraction (NSS) algorithm, the delay-and-sum beamformer (DSBF), and the dereverberation technique of Allen, Berkley, and Blauert (ABB). The GEQ-I array acts as a DSBF followed by a NSS-type processor. The GEQ-I gain is very similar to the original gain of the ABB technique. The GEQ-II array is a generalization of the DSBF that trades off additional signal degradation for additional interference suppression. The GEQ-II gain is very similar to a modification of the ABB gain proposed by Bloom and Cain.

Using the power function spectral distance (PFSD) measure, the signal-to-noise ratio (SNR), and listening tests, we tested the performance of the GEQ-I and GEQ-II arrays versus that of the NSS algorithm, the DSBF, and the Frost array [28]. We used the PFSD measure, because it was found in [30] to be better correlated with the diagnostic acceptability measure than was the SNR. The GEQ-I array worked best for the case of a desired signal in uncorrelated white background noise. The GEQ-II array worked best for the overdetermined case in which the interference sources were widely separated. The Frost array worked best for the case of a desired signal corrupted by a single interference signal and for the overdetermined case in which the interference sources were closely spaced.

References

[1] J. Yang, "Frequency domain noise suppression approaches in mobile telephone systems," in *Proceedings of the International Conference on Acoustics, Speech, and Signal Processing,* (Minneapolis, Minn.), pp. II-363–366, April 1993.

[2] S. Oh, V. Viswanathan, and P. Papamichalis, "Hands-free voice communication in an automobile with a microphone array," in *Proceedings of the International Conference on Acoustics, Speech, and Signal Processing,* (San Francisco, Calif.), pp. 281–284, March 1992.

[3] Y. Grenier, "A microphone array for car environments," in *Proceedings of the International Conference on Acoustics, Speech, and Signal Processing,* (San Francisco, Calif.), pp. 305–308, March 1992.

[4] M. M. Goulding and J. S. Bird, "Speech enhancement for mobile telephony," *IEEE Transactions on Vehicular Technology,* vol. 39, pp. 316–326, November 1990.

[5] I. Claesson, S. E. Nordholm, B. A. Bengtsson, and P. Eriksson, "A multi-DSP implementation of a broadband adaptive beamformer for use in a hands-free mobile radio telephone," *IEEE Transactions on Vehicular Technology,* vol. 40, pp. 194–202, February 1991.

[6] Y. Ephraim, "Statistical-model-based speech enhancement systems," *Proceedings of the IEEE,* vol. 80, pp. 1526–1555, October 1992.

[7] G. A. Powell, P. Darlington, and P. D. Wheeler, "Practical adaptive noise reduction in the aircraft cockpit environment," in *Proceedings of the International Conference on Acoustics, Speech, and Signal Processing,* (Dallas, Tex.), pp. 173–176, April 1987.

[8] J. J. Rodriguez, J. S. Lim, and E. Singer, "Adaptive noise reduction in aircraft communication systems," in *Proceedings of the International Conference on Acoustics, Speech, and Signal Processing,* (Dallas, Tex.), pp. 169–172, April 1987.

[9] W. A. Harrison, J. S. Lim, and E. Singer, "A new application of adaptive noise cancellation," *IEEE Transactions on Acoustics, Speech, and Signal Processing,* vol. 34, pp. 21–27, February 1986.

[10] J. R. Deller, Jr., J. G. Proakis, and J. H. L. Hansen, *Discrete-Time Processing of Speech Signals.* New York: Macmillan, 1993.

[11] E. McKinney and V. DeBrunner, "Directionalizing adaptive multi-microphone arrays for hearing aids using cardioid microphones," in *Proceedings of the International Conference on Acoustics, Speech, and Signal Processing,* (Minneapolis, Minn.), pp. I-177–180, April 1993.

[12] D. Chazan, Y. Medan, and U. Shvadron, "Noise cancellation for hearing aids," *IEEE Transactions on Acoustics, Speech, and Signal Processing,* vol. 36, pp. 1697–1705, November 1988.

[13] P. M. Peterson, "Using linearly-constrained adaptive beamforming to reduce interference in hearing aids from competing talkers in reverberant rooms," in *Proceedings of the International Conference on Acoustics, Speech, and Signal Processing,* (Dallas, Tex.), pp. 5.7.1–4, April 1987.

[14] L. R. Rabiner and B.-H. Juang, *Fundamentals of Speech Recognition.* Englewood Cliffs, N.J.: Prentice-Hall, 1993.

[15] Y. Kaneda and J. Ohga, "Adaptive microphone-array system for noise reduction," *IEEE Transactions on Acoustics, Speech, and Signal Processing,* vol. 34, pp. 1391–1400, December 1986.

[16] K. Farrell, R. J. Mammone, and J. L. Flanagan, "Beamforming microphone arrays for speech enhancement," in *Proceedings of the International Conference on Acoustics, Speech, and Signal Processing,* (San Francisco, Calif.), pp. 285–288, March 1992.

[17] T. Switzer, D. Linebarger, E. Dowling, Y. Tong, and M. Munoz, "A customized beamformer system for acquisition of speech signals," in *Proceedings of the 25th Asilomar Conference on Signals, Systems & Computers,* pp. 339–343, November 1991.

[18] J. L. Flanagan, R. Mammone, and G. W. Elko, "Autodirective microphone systems for natural communication with speech recognizers," in *Proceedings of the DARPA Speech and Natural Language Workshop,* (Pacific Grove, Calif.), pp. 170–175, February 1991.

[19] J. L. Flanagan, J. D. Johnston, R. Zahn, and G. W. Elko, "Computer-steered microphone arrays for sound transduction in large rooms," *Journal of the Acoustical Society of America,* vol. 78, pp. 1508–1518, November 1985.

[20] J. L. Flanagan, "Bandwidth design for speech-seeking microphone arrays," in *Proceedings of the International Conference on Acoustics, Speech, and Signal Processing,* (Tampa, Fla.), pp. 732–735, March 1985.

[21] V. M. Alvarado and H. F. Silverman, "Experimental results showing the effects of optimal spacing between elements of a linear microphone array," in *Proceedings of the International Conference on Acoustics, Speech, and Signal Processing,* (Albuquerque, N.M.), pp. 837–840, April 1990.

[22] D. H. Johnson and D. E. Dudgeon, *Array Signal Processing: Concepts and Techniques.* Englewood Cliffs, N.J.: Prentice-Hall, 1993.

[23] R. A. Mucci, "A comparison of efficient beamforming algorithms," *IEEE Transactions on Acoustics, Speech, and Signal Processing,* vol. 32, pp. 548–558, June 1984.

[24] R. T. Compton, Jr., *Adaptive Antennas: Concepts and Performance.* Englewood Cliffs, N.J.: Prentice-Hall, 1988.

[25] B. D. Van Veen and K. M. Buckley, "Beamforming: A versatile approach to spatial filtering," *IEEE ASSP Magazine,* vol. 5, pp. 4–24, April 1988.

[26] S. Haykin and A. Steinhardt, eds., *Adaptive Radar Detection and Estimation.* New York: Wiley, 1992.

[27] L. J. Griffiths and C. W. Jim, "An alternative approach to linearly constrained beamforming," *IEEE Transactions on Antennas and Propagation,* vol. AP-30, pp. 27–34, January 1982.

[28] O. L. Frost, III, "An algorithm for linearly constrained adaptive array processing," *Proceedings of the IEEE,* vol. 60, pp. 926–935, August 1972.

[29] R. E. Slyh, *Microphone Array Speech Enhancement in Background Noise and Overdetermined Signal Scenarios.* PhD dissertation, The Ohio State University, March 1994.

[30] S. R. Quackenbush, T. P. Barnwell III. and M. A. Clements, *Objective Measures of Speech Quality.* Englewood Cliffs, N.J.: Prentice-Hall, 1988.

[31] S. F. Boll, "Suppression of acoustic noise in speech using spectral subtraction," *IEEE Transactions on Acoustics, Speech, and Signal Processing,* vol. 27, pp. 113–120, April 1979. Reprinted in *Speech Enhancement,* J. S. Lim, ed., Englewood Cliffs, N.J.: Prentice-Hall, 1983.

[32] M. Berouti, R. Schwartz, and J. Makhoul, "Enhancement of speech corrupted by acoustic noise," in *Proceedings of the International Conference on Acoustics, Speech, and Signal Processing,* pp. 208–211, April 1979. Reprinted in *Speech Enhancement,* J. S. Lim, ed., Englewood Cliffs, N.J.: Prentice-Hall, 1983.

[33] R. J. McAulay and M. L. Malpass, "Speech enhancement using a soft-decision noise suppression filter," *IEEE Transactions on Acoustics, Speech, and Signal Processing,* vol. 28, pp. 137–145, April 1980. Reprinted in *Speech Enhancement,* J. S. Lim, ed., Englewood Cliffs, N.J.: Prentice-Hall, 1983.

[34] Y. Ephraim and D. Malah, "Speech enhancement using a minimum mean square error short-time spectral amplitude estimator," *IEEE Transactions on Acoustics, Speech, and Signal Processing,* vol. 32, pp. 1109–1121, December 1984.

[35] L. R. Rabiner and R. W. Schafer, *Digital Processing of Speech Signals.* Englewood Cliffs, N.J.: Prentice-Hall, 1978.

[36] M. K. Portnoff, "Short-time Fourier analysis of sampled speech," *IEEE Transactions on Acoustics, Speech, and Signal Processing,* vol. 29, pp. 364–373, June 1981. Reprinted in *Speech Enhancement,* J. S. Lim, ed., Englewood Cliffs, N.J.: Prentice-Hall, 1983.

[37] J. B. Allen, D. A. Berkley, and J. Blauert, "Multimicrophone signal-processing technique to remove room reverberation from speech signals," *Journal of the Acoustical Society of America,* vol. 62, pp. 912–915, October 1977.

[38] P. J. Bloom and G. D. Cain, "Evaluation of two-input speech dereverberation techniques," in *Proceedings of the International Conference on Acoustics, Speech, and Signal Processing,* (Paris, France), pp. 164–167, May 1982.

[39] H. F. Silverman, "An algorithm for determining talker location using a linear microphone array and optimal hyperbolic fit," in *Proceedings of the DARPA Speech and Natural Language Workshop,* (Hidden Valley, Pa.), pp. 151–156, June 1990.

[40] K. U. Simmer, P. Kuczynski, and A. Wasiljeff, "Time delay compensation for adaptive multichannel speech enhancement systems," in *Proceedings of the URSI International Symposium on Signals, Systems, and Electronics,* pp. 660–663, September 1992. Reprinted in *Coherence and Time Delay Estimation: An Applied Tutorial for Research, Development, Test, and Evaluation Engineers,* G. C. Carter, ed., Piscataway, N.J.: IEEE Press, 1993.

[41] J. S. Lim and A. V. Oppenheim, "Enhancement and bandwidth compression of noisy speech," *Proceedings of the IEEE,* vol. 67, pp. 1586–1604, December 1979. Reprinted in *Speech Enhancement,* J. S. Lim, ed., Englewood Cliffs, N.J.: Prentice-Hall, 1983.

[42] N. Ahmed, T. Natarajan, and K. R. Rao, "Discrete cosine transform," *IEEE Transactions on Computers,* vol. 23, pp. 90–93, January 1974.

[43] K. R. Rao and P. Yip, *Discrete Cosine Transform: Algorithms, Advantages, and Applications.* Boston, Mass.: Academic Press, 1990.

[44] S. S. Narayan, A. M. Peterson, and M. J. Narasimha, "Transform domain LMS algorithm," *IEEE Transactions on Acoustics, Speech, and Signal Processing,* vol. 31, pp. 609–615, June 1983.

It is understood that certain modifications to the invention as described may be made, as might occur to one with skill in the field of the invention, within the scope of the appended claims. Therefore, all embodiments contemplated hereunder which achieve the objects of the present invention have not been shown in complete detail. Other embodiments may be developed without departing from the scope of the appended claims.

What is claimed is:

1. Apparatus which relates to a microphone array speech enhancement algorithm based on analysis/synthesis filtering that allows for variable signal distortion, which is used to suppress additive noise and interference; wherein the apparatus comprises a microphone array of K sensors, processing structure means for delaying received signals so that desired signal components add coherently, means for filtering each delayed signal through an analysis filter bank to generate a plurality of channel signals, means for summing corresponding channel signals from said sensors, means for applying a signal degrading and noise suppressing independent weighting gain to each said channel signal, and means for combining gain-weighted channel signals using a synthesis filter.

2. Apparatus according to claim 1, which is a Graphic Equalizer (GEQ) array with K=2, and said K sensors comprise first and second sensors, wherein said means for filtering each of said delayed signals includes means employing a short-time discrete cosine transform, and said means for applying a different weighting gain to each said channel uses a function which is based on a cross correlation of channel signals from said sensors.

3. Apparatus according to claim 2, wherein said means for applying a gain to the channel outputs uses means for calculating a gain function (GEQ-II array) for a channel n and a time k, comprising means for applying a rectangular window of length $N_C$ centered about time k to output sequences from the nth channel of the first and second sensors, $N_C$ being an adjustable parameter, to provide a process which yields first and second vectors of length $N_C$, means for computing the sum of the squares of the elements in the first vector, which yields an energy of the first vector, means for computing the sum of the squares of the elements in the second vector, which yields an energy of the second vector, means for forming a geometric mean of said two energies by taking a square root of a product of the two energies, means for computing a cross correlation between the two vectors (i.e. computing the product of the transpose of the first vector with the second vector), means for forming a correlation coefficient by dividing the cross correlation by the geometric mean of the two energies, and means for taking the absolute value of the correlation coefficient to the b(n) power and multiplying the result by ½, b(n) being an adjustable parameter.

4. Microphone-array apparatus comprising:

A. a plurality of microphone elements for converting acoustic signals into electrical microphone output signals;

B. analysis filtering means connected with said microphone output signals for generating a plurality of channel signals for each of said microphone output signals, each microphone output signal connecting with an identical different analysis filtering element and each said different analysis filtering element having corresponding output channels of like frequency characteristics;

C. channel summing means, including an identical different channel summing element connected with each said analysis filtering element output channel of like frequency characteristics, to generate a plurality of like-channel sum signals;

D. weighting means, including a plurality of weighting elements each connected to one of said like-channel sum signals, for generating weighted like-channel sum signals and for trading additional degradation of a selected signal component in each said like-channel sum signal for additional suppression of noise and interference components present in said like-channel sum signal, each said like-channel sum signal trade being independent of each other such trade;

E. synthesis filtering means for filtering and combining said weighted like-channel sum signals into an output signal.

5. The microphone-array apparatus of claim 4 wherein said synthesis filtering means output signal comprises a non filtered summation of said weighted like-channel sum signals.

6. The microphone-array apparatus of claim 4 wherein:

said apparatus further includes delaying means located between said microphone elements and said analysis filtering means;

said delaying means being connected with a microphone output electrical signal of each microphone in said array for generating a plurality of coherently combinable delayed microphone output signals,

7. The microphone-array apparatus of claim 6 wherein said synthesis filtering means output signal comprises a non filtered summation of said weighted like-channel sum signals.

8. Additive noise and interference-suppressing microphone array speech enhancement apparatus comprising the combination of:

a K element array of microphones each connected to an input signal path;

an array of signal delaying elements, each of coherent signal-addition-enabling delay interval, located in said input signal paths;

an array of similar analysis filters located one in each of said input signal paths, each said analysis filter having a plurality of selected frequency components-inclusive signal output channels;

a signal summing element connected to a corresponding signal output channel of each said analysis filter;

an array of weighting function elements each connected to an output port of a signal summing element;

each of said weighting function elements including an independently determined and signal cross correlation-controlled gain selection element;

each of said gain selection elements having an increased signal distortion with increased noise suppression characteristic;

an output signal generating synthesis filter element connected with an output signal port of each said weighting function element.

* * * * *